US008997412B1

(12) United States Patent
Header

(10) Patent No.: US 8,997,412 B1
(45) Date of Patent: Apr. 7, 2015

(54) COMBINATION MARINE AND STOP FRAME GLAZED PANEL

(71) Applicant: Gregory Header, Richland, PA (US)

(72) Inventor: Gregory Header, Richland, PA (US)

( * ) Notice: Subject to any disclaimer, the term of this patent is extended or adjusted under 35 U.S.C. 154(b) by 0 days.

(21) Appl. No.: 14/219,762

(22) Filed: Mar. 19, 2014

(51) Int. Cl.
*E06B 3/54* (2006.01)
*E04B 2/96* (2006.01)
*E06B 1/18* (2006.01)

(52) U.S. Cl.
CPC . *E04B 2/967* (2013.01); *E04B 2/96* (2013.01); *E06B 3/5427* (2013.01); *E06B 3/5454* (2013.01); *E06B 1/18* (2013.01)

(58) Field of Classification Search
CPC ..... E04B 2/967; E04B 2/96; E06B 3/5427; E06B 3/5454; E06B 3/54; E06B 1/12; E06B 1/14; E06B 1/18
USPC ..... 52/204.71, 204.62, 204.67, 204.7, 52/204.705; 49/501, 504
See application file for complete search history.

(56) References Cited

U.S. PATENT DOCUMENTS 2,918,708 A * 12/1959 Sharp et al. ..... 52/656.3
3,299,596 A * 1/1967 Neal et al. ..... 52/476
3,388,517 A 6/1968 Wohl et al.
4,555,868 A 12/1985 Mancuso
4,621,478 A * 11/1986 Phillips et al. ..... 52/775
4,747,248 A * 5/1988 Fahs ..... 52/455
5,012,616 A 5/1991 Martin
5,042,212 A * 8/1991 Golen ..... 52/204.591
5,761,860 A * 6/1998 Koike et al. ..... 52/204.67
5,806,256 A 9/1998 Byrne
5,860,264 A * 1/1999 Gephart et al. ..... 52/656.4
6,829,868 B1 * 12/2004 Frey ..... 52/204.62
7,138,166 B2 11/2006 Rinehart
2004/0234731 A1 11/2004 Rinehart

OTHER PUBLICATIONS

SL 35 Detail Sections Folding Glass Door, Jun. 2010, Solarlux Aluminum Systeme GmbH, Germany.
SL 60e Detail Sections Folding Glass Door, Jan. 2013, Solarlux Aluminum Systeme GmbH, Germany.
GANA Glazing Manual 50th Edition, pp. 135-136, p. 168 (bottom), 2009, Glass Association of North America.

* cited by examiner

*Primary Examiner* — Brent W Herring
(74) *Attorney, Agent, or Firm* — Stone Creek Services LLC; Alan M Flum

(57) ABSTRACT

Disclosed is a framed glazed door or wall panel that can be utilized in applications requiring structural rigidity of the panel frame such as pivot doors, hinged doors, or glass folding doors. The panel includes marine glaze vertical frame members and horizontal stop glaze frame members. The vertical frame members and horizontal frame members can be joined by corner lugs inserted the body of the horizontal frame members and captively held in grooves on the surface of the vertical frame members.

7 Claims, 18 Drawing Sheets

COMBINATION MARINE AND STOP FRAME GLAZED PANEL

BACKGROUND

The present disclosure relates to glazed door, windows, and wall structures. Specifically, the present disclosure relates to glazed door, window, and wall panels with structurally supporting frames.

Framed and glazed door and wall structures can be found in both commercial and residential environments, for example, framed glass pivot doors, swing doors, sliding glass doors, or folding glass doors. Two common types of framed glass panels are marine glazing and stop glazing. Marine glazing generally utilizes a marine glazing gasket, which wraps around the edge of the glass and is held in a u-shaped channel within the glazing frame. Stop glazing utilizes glazing stops that slide, snap, or otherwise attach to the glazing frame on either side of the glass panel.

Marine glazed frames often have a narrower frame profile than stop glazing frame systems due to the nature of the frame's construction. However, marine glazing system frames often lack rigidity. These systems typically rely on fasteners engaged into screw bosses. Marine glazing is commonly used in applications where the weight of both the frame and the glass, is center supported where corners stiffness is not required. Marine glaze systems are often used in applications such as top load and/or bottom load sliding doors, fixed glass panels, and other similar applications. In contrast, stop glazing systems achieve their rigidity by utilizing a made to fit extruded lugs which enables the system to transfer forces from one frame element to another in a more efficient and economical way allowing a broader list of applications. Stop glazing systems are often used in eccentric systems such as hinged swing glass doors, pivot glass doors, folding doors and others.

SUMMARY

The inventor desired to achieve a vertical frame narrower than conventional stop glaze doors structures for applications that could benefit from a structurally rigid frame such as pivot glass doors, hinged glass doors, and glass folding doors. After many months of trial and error, the inventor recognized that a narrower vertical frame profile could be achieved for applications benefiting from a structurally rigid frame, by combining marine type glazing vertical frame members with stop glaze horizontal frame members.

One of the challenges faced by the inventor was how to join the vertical marine glaze frame members and horizontal stop glaze frame members together and create a structurally rigid frame capable of supporting the glazed framed door panel for applications such as pivot doors, hinged doors, and glass folding doors. The inventor recognized that such a structurally rigid frame could be realized by utilizing a lug that engages the inward facing exterior surface of the vertical marine glaze frame member and at the same time engages and secured a hollow interior portion of the horizontal stop glaze frame member. This arrangement creates a rigid corner joint between the horizontal stop glaze frame member and the vertical marine glaze frame member. Because the lug is secured to the outside surface of the vertical marine glaze frame member, the corner joint does not rely on the face width or interior structure of the vertical marine glaze frame member. This allows for the possibility of creating a narrow vertical marine glaze frame member front face while maintaining a corner joint with sufficient structural integrity so that the frame itself is rigid enough to support the door or wall panel.

The surface engagement between the lug and the vertical marine glaze frame member can be accomplished by captively and slidably engaging the lug lengthwise along the inward facing exterior surface of the vertical marine glaze frame member. For example, the lug can include one or more vertical ridges, the vertical ridges can captively engage corresponding one or more lengthwise slots along the inward facing exterior surface of the vertical marine glaze frame member. Alternatively, the lug can be constructed that is secured directly to the surface of the vertical marine glaze frame member without captive slidable engagement.

This Summary has introduced a selection of concepts, in simplified form, that is described further in the Description to give the reader an overview of the disclosed subject matter. The Summary is not intended to identify essential features or limit the scope of the claimed subject matter.

DRAWINGS

DESCRIPTION

The terms "left", "right", "top", "bottom", "upper", "lower", "vertical", "horizontal", "front", "back", and "side" are relative terms used throughout the disclosure to aid in the understanding of the figures. Unless otherwise indicated, these terms are not used to denote absolute direction, or orientation. They are not meant to imply a particular preference or limitation for a particular orientation or direction. In addition, measurements, including widths, are given throughout this disclosure. These measurements are given to help the reader understand the scale and advantage of the present disclosure. It should be understood by the reader that any dimension given is typical, other widths and heights are possible, and the claimed invention is in no way limited to any measurements, widths, or ranges recited in the Description.

Figure 1:
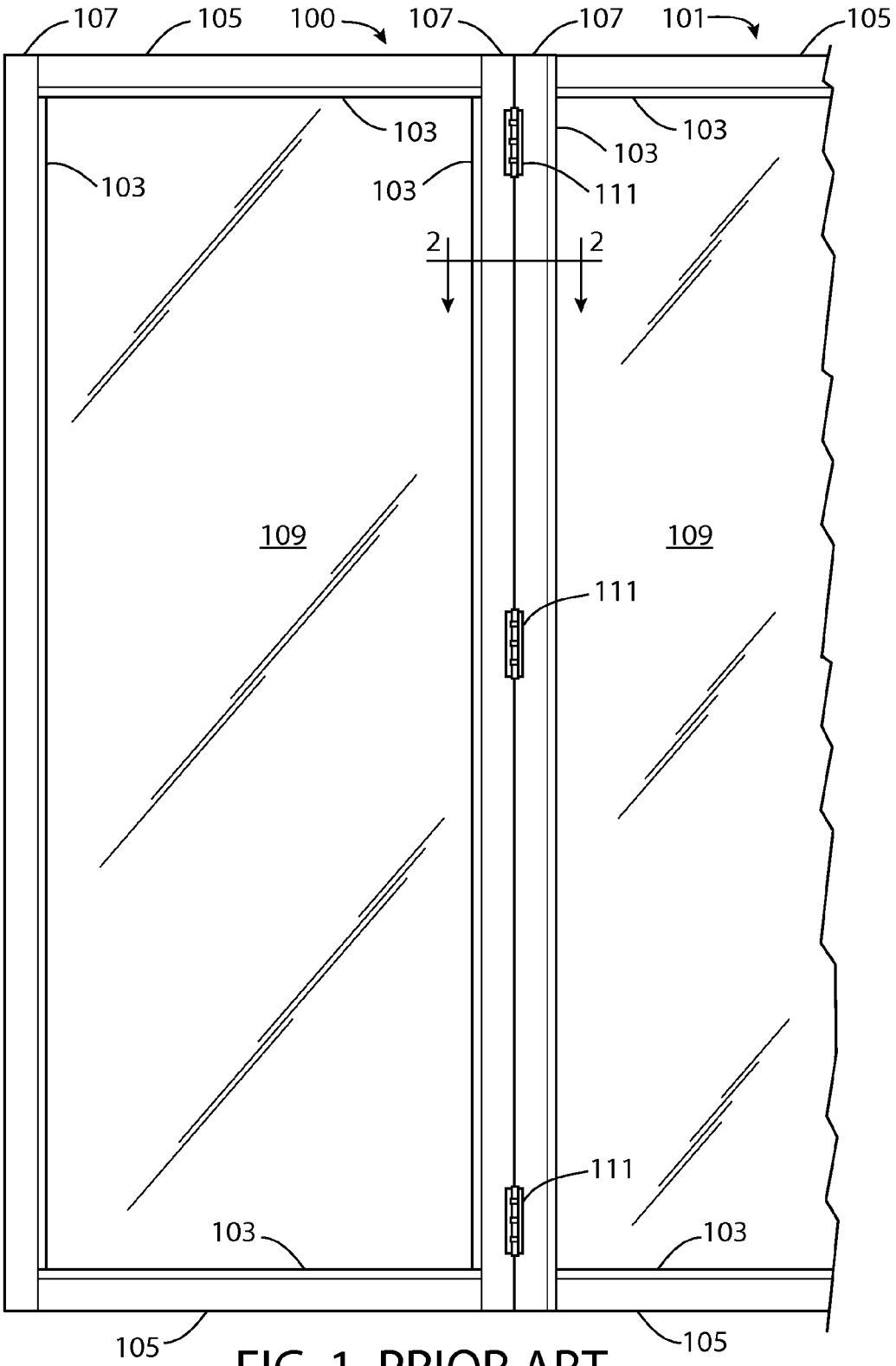
FIG. 1 PRIOR ART
FIG. 1 illustrates a stop glaze framed door panel and a portion of a second stop glazed framed door panel in the prior art.

The following description is made with reference to figures, where like numerals refer to like elements throughout the several views. FIG. 1 illustrates a stop glaze framed door panel 100 and a portion of a second stop glazed framed door panel 101 in the prior art. Both the stop glaze framed door panel 100 and the second stop glazed framed door panel 101 utilize glazing stops 103 attached to horizontal stop glaze frame members 105, vertical stop glaze frame members 107, and surrounding each glass panel 109. The stop glaze framed door panel 100 and the second stop glazed framed door panel 101 are joined together along the vertical stop glaze frame members 107 by hinges 111.

Figure 2:
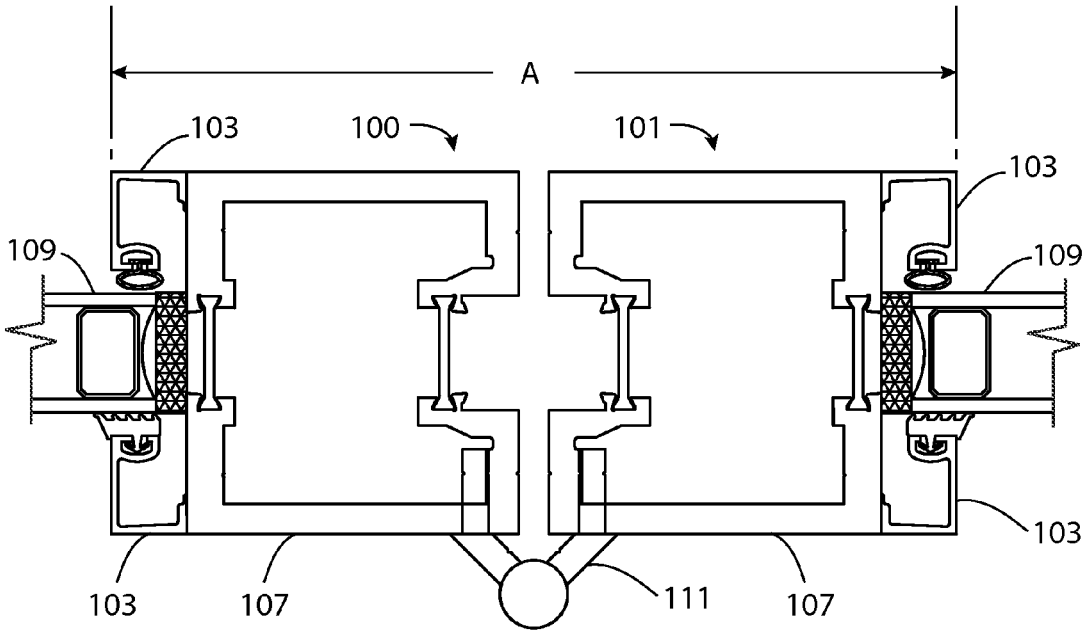
FIG. 2 PRIOR ART
FIG. 2 illustrates a cross sectional view of the stop glazed framed door panel and the portion of the second stop glazed framed door panel of FIG. 1 taken along section lines 2-2.

FIG. 2 illustrates a cross sectional view of the stop glaze framed door panel 100 and the second stop glazed framed door panel 101 of FIG. 1 taken along section lines 2-2. The width of the vertical stop glaze frame members 107 joined between the stop glaze framed door panel 100 and the second stop glazed framed door panel 101 together in the closed position is represented by the letter "A." Measurement A typically is 5 inches (0.127 m) to 8 inches (0.203 m). FIG. 2 shows the relationship between the glazing stops 103, the glass panel 109 and each of the stop glaze framed door panel 100 and the second stop glazed framed door panel 101. The stop glaze framed door panel 100 and the second stop glazed framed door panel 101 are shown joined by the hinges 111. Both the stop glaze framed door panel 100 and the second stop glazed framed door panel 101 are structured to create a thermal break between the outside and inside of the door panels.

Figure 3:
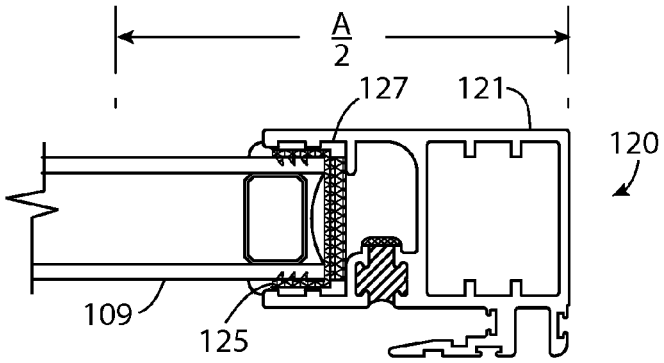
FIG. 3 PRIOR ART
FIG. 3 illustrates a sectional view taken along lines 3-3 in FIG. 5.
Figure 4:
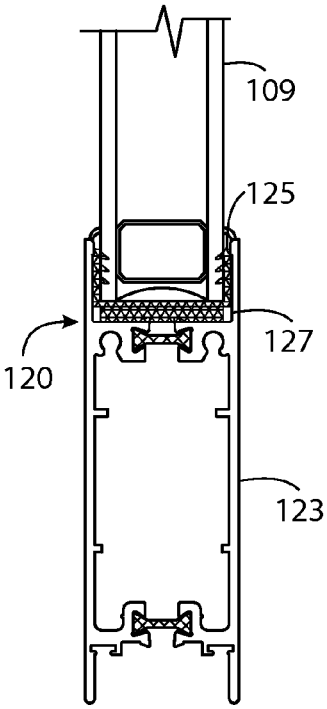
FIG. 4 PRIOR ART
FIG. 4 illustrates a sectional view taken along lines 4-4 in FIG. 5.
Figure 5:
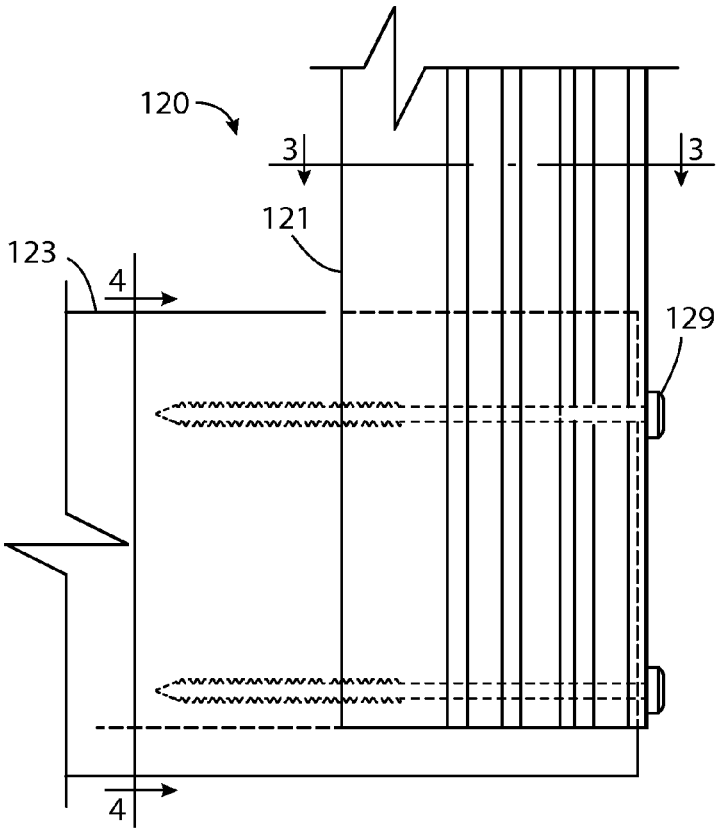
FIG. 5 PRIOR ART
FIG. 5 illustrates a front detail view of the corner connection of the marine glaze framing system.

In order to aid the reading in understanding the differences between a stop glazed style frame and a marine glaze style frame, FIGS. 3-6 illustrate a corner connection detail of a typical of a marine glaze framing system 120 in the prior art. FIG. 3 illustrates a sectional view taken along lines 3-3 in FIG. 5. FIG. 4 illustrates a sectional view taken along lines 4-4 in FIG. 5. FIG. 5 illustrates a front detail view of the corner connection of the marine glaze framing system 120. The marine glaze framing system 120 of FIGS. 3-5 include a vertical marine glaze frame member 121 and a horizontal glaze frame member 123. In FIGS. 3-4, marine glaze gaskets 125 wrap around the end of the glass between the glass panel 109 and set within a glazing channel 127 within either the vertical marine glaze frame member 121 of FIG. 3 or the horizontal glaze frame member 123 of FIG. 4. Like the stop glaze framed door panel 100 illustrated in FIGS. 1-2, the both the vertical marine glaze frame member 121 and the horizontal glaze frame member 123 include thermal breaks in order to insulate the inside environment from the outside temperature. A marine glazing system can potentially have a narrower profile than a stop glaze system. This is illustrated by distance A/2 in FIG. 3, which represents the width of the vertical stop glaze frame member of FIG. 2.

Figure 6:
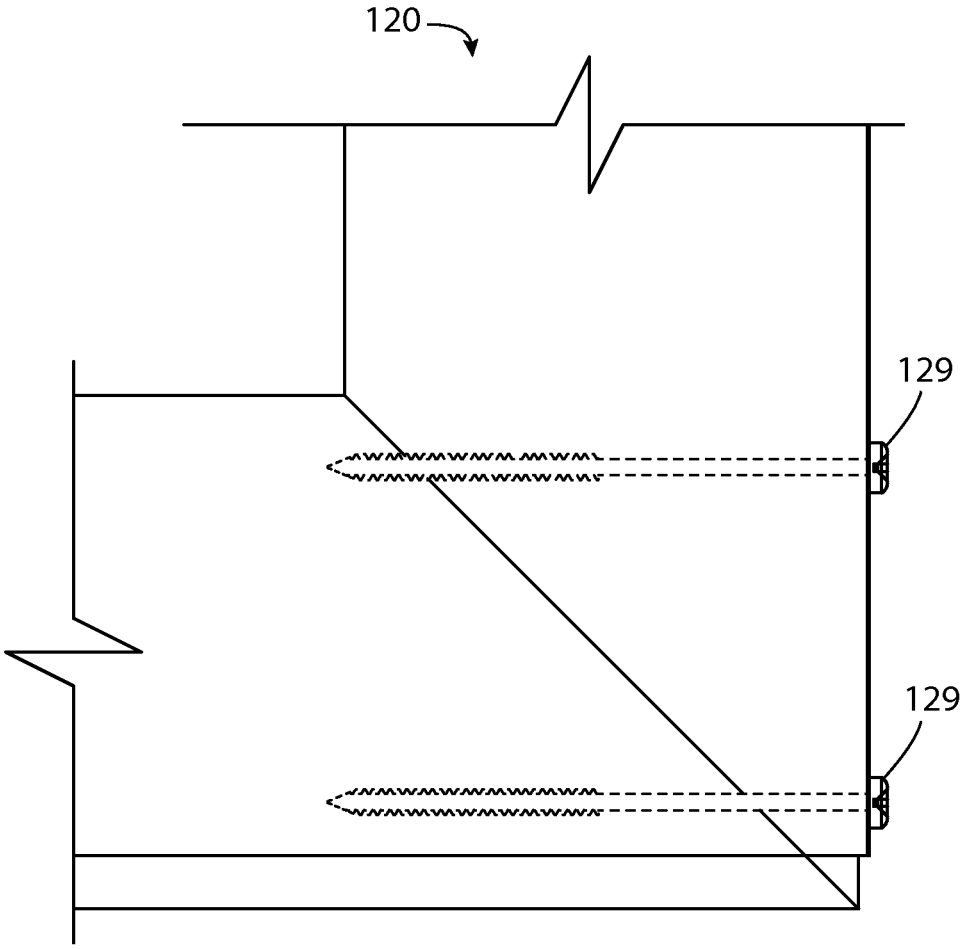
FIG. 6 PRIOR ART
FIG. 6 illustrates a front detail view of an alternative corner connection of a marine glaze framing system, using mitered corners, in the prior art.

Marine glaze framing systems 120, such as those illustrated in FIGS. 3-4 often depend on the structural integrity of the glass panel 109, because the frames are not rigid. FIG. 5 illustrates how the vertical marine glaze frame member 121 and the horizontal glaze frame member 123 are typically fastened by sheet metal screws 129 using a butt joint. FIG. 6 illustrates a front detail view of an alternative corner connection of the marine glaze framing system 120 using mitered corners, and using sheet metal screws 129 to maintain the corner connection, in the prior art. The corner connections illustrated in both FIGS. 5 and 6, typical of marine glaze systems, have limited structural rigidity. In general, the limited structural rigidity of the marine glaze systems, typical in the art, makes them suitable for supported applications such as fixed door panels or horizontal sliding glass doors or wall panels.

Figure 7:
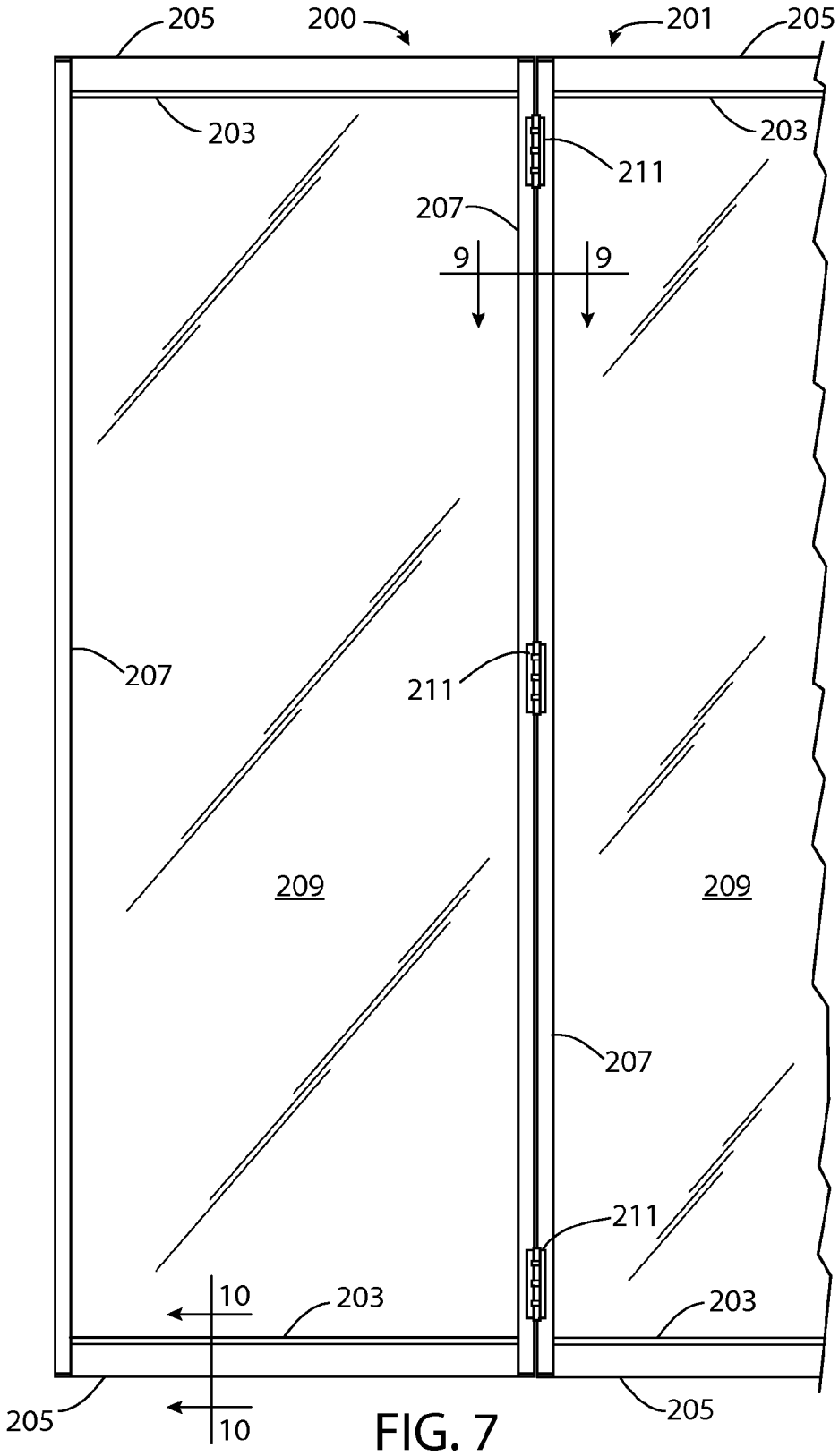
FIG. 7 illustrates, a front view, of a glazed and framed door panel and a portion of a second glazed and framed door panel, of the present disclosure, including horizontal stop glaze frame members, and vertical marine glaze frame members.

The inventor desired to achieve a vertical frame narrower in front and rear profile than conventional stop glaze doors structures, such as those in FIGS. 1-2 for applications requiring structurally rigid frame. After many months of trial and error, the inventor recognized that a narrower vertical frame profile could be achieved for pivot doors, hinged doors, glass folding doors, or other applications requiring a structurally rigid frame, by combining marine type glazing vertical frame members with stop glaze horizontal frame members. This approach has the advantage of the structural stability of a horizontal stop glaze frame members while maintaining a narrow profile for the vertical frame member. FIG. 7 illustrates a front view, and FIG. 8 lower right hand portion perspective view, of a glazed framed door panel 200 and a portion of a second glazed framed door panel 201, of the present disclosure, including horizontal stop glaze frame members 205, and vertical marine glaze frame members 207. The horizontal stop glaze frame members 205 include glazing stops 203. The vertical marine glaze frame members 207, and horizontal stop glaze frame members 205 surround a glass panel 209. The glazed framed door panel 200 and the portion of a second glazed framed door panel 201 are joined by hinges 211 as typical of a framed folding glass door or, alternatively, a swing door.

Figure 9:
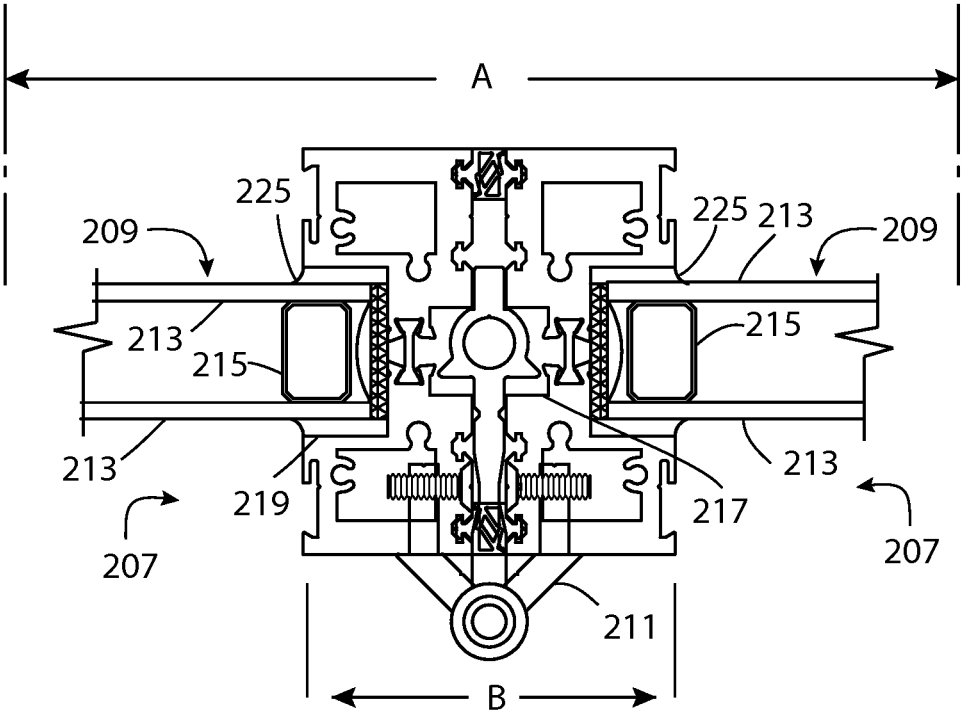
FIG. 9 illustrates a sectional view of the vertical marine glaze frame members adjoining in FIG. 7 taken along section lines 9-9.

FIG. 9 illustrates a sectional view of the vertical marine glaze frame members 207 adjoining in FIG. 7 taken along section lines 9-9 illustrating the vertical marine glaze frame members 207 joined by the hinges 211. The width of the vertical marine glaze frame members 207 adjoining from glazed framed door panel 200 and the second glazed framed door panel 201 of FIG. 7 together is represented by measurement B. Measurement B can typically be 2.5 inches (0.0635 m) for a standard height door, but can be wider or narrower depending on material strength, door height and required structural rigidity. This is significantly narrower than measurement A from FIG. 2, which can typically be 7 inches (0.178 m). FIG. 9 illustrates the glass panels 209 that each include two plates of glass 213 separated by spacers 215. The front and back of each of the vertical marine glaze frame members 207 includes a thermal break formed by an internal cavity 217 within each of the vertical marine glaze frame members 207. The each of the glass panels 209 is seated in u-shaped channels 219 formed inward from the surface of vertical marine glaze frame members 207. Marine glaze gaskets 225 surround the ends of each of the glass panels 209 where they are seated in the u-shaped channels 219.

Figure 10:
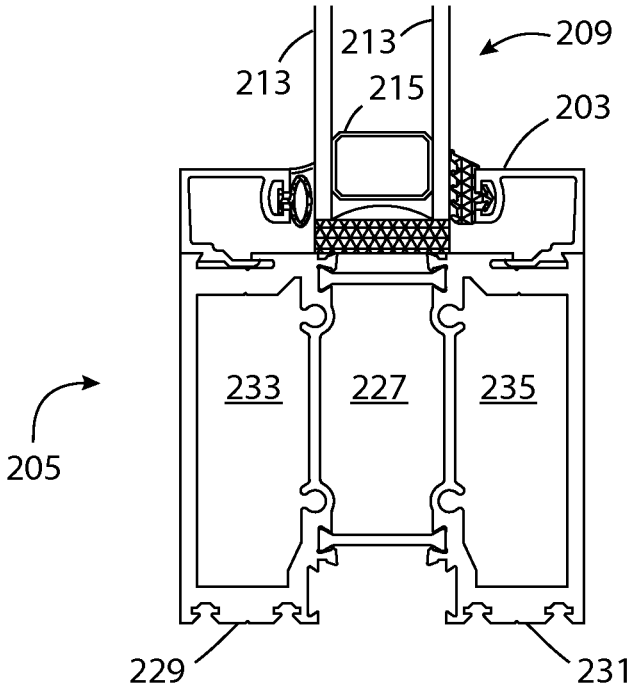
FIG. 10 illustrates a sectional view of the horizontal stop glaze frame member of FIG. 7 taken along section lines 10-10 in FIG. 7 showing the glass panel in relation to the glazing stops.
Figure 11:
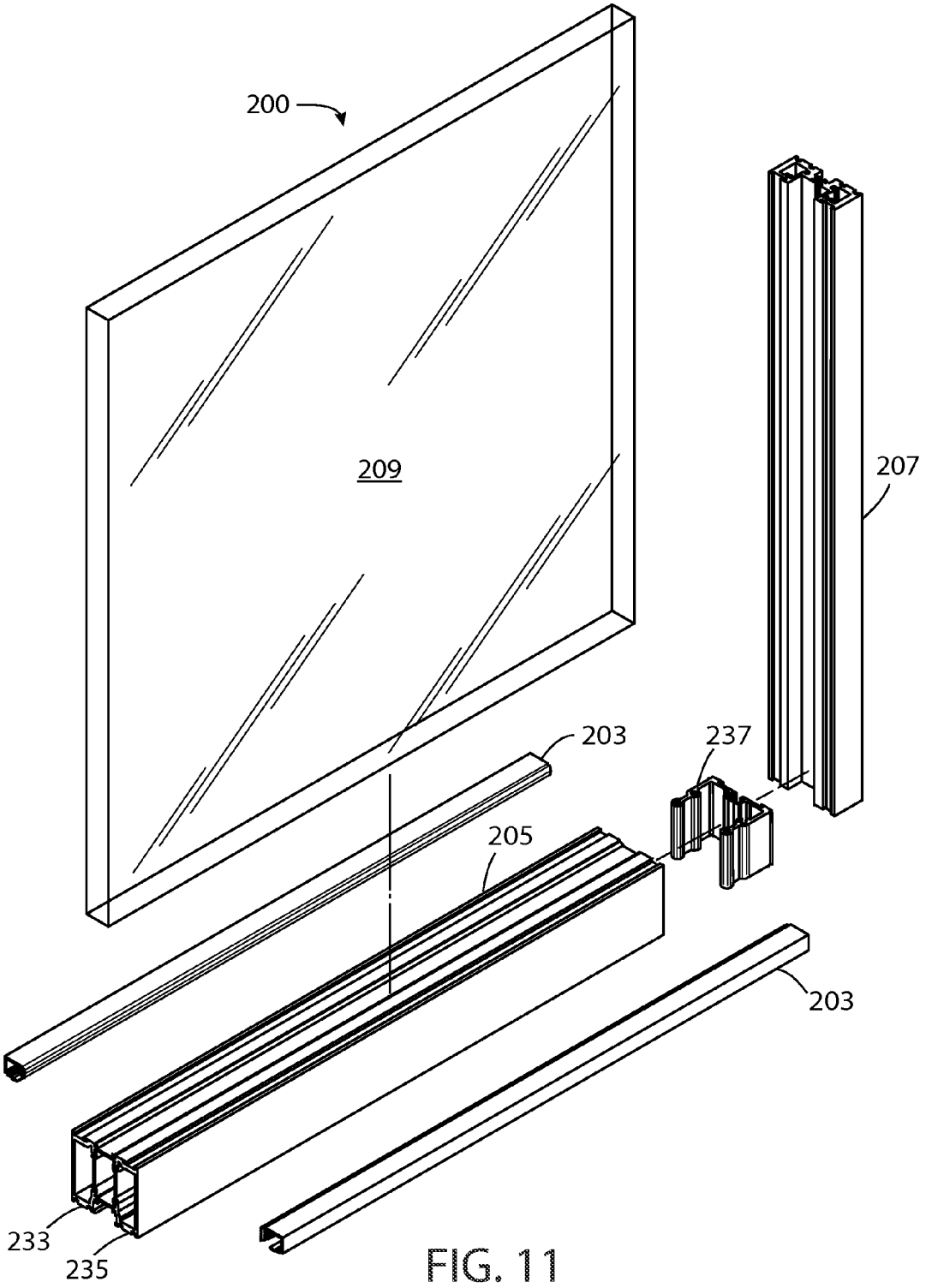
FIG. 11 illustrates exploded view of the lower right hand portion of the glazed framed door panel of FIG. 7.

FIG. 10 illustrates a sectional view of the horizontal stop glaze frame member 205 of FIG. 7 taken along section lines 10-10 in FIG. 7 showing the glass panel 209 in relation to the glazing stops 203. As with the vertical marine glaze frame member 207, each of the plates of glass 213 making up the glass panel 209 is separated by the spacer 215. The horizontal stop glaze frame member 205 includes a thermal break formed by a cavity 227 between a first section 229 and a second section 231 of the horizontal stop glaze frame member 205. The first section 229 includes a first section hollow interior portion 233 and the second section hollow interior portion 235 extending longitudinally along the horizontal stop glaze frame member 205. FIG. 11, which is an exploded view of the lower right hand portion of the glazed framed door panel 200 of FIG. 7, further illustrates the glass panel 209, glazing stops 203, horizontal stop glaze frame members 205, and vertical marine glaze frame members 207.

Figure 8:
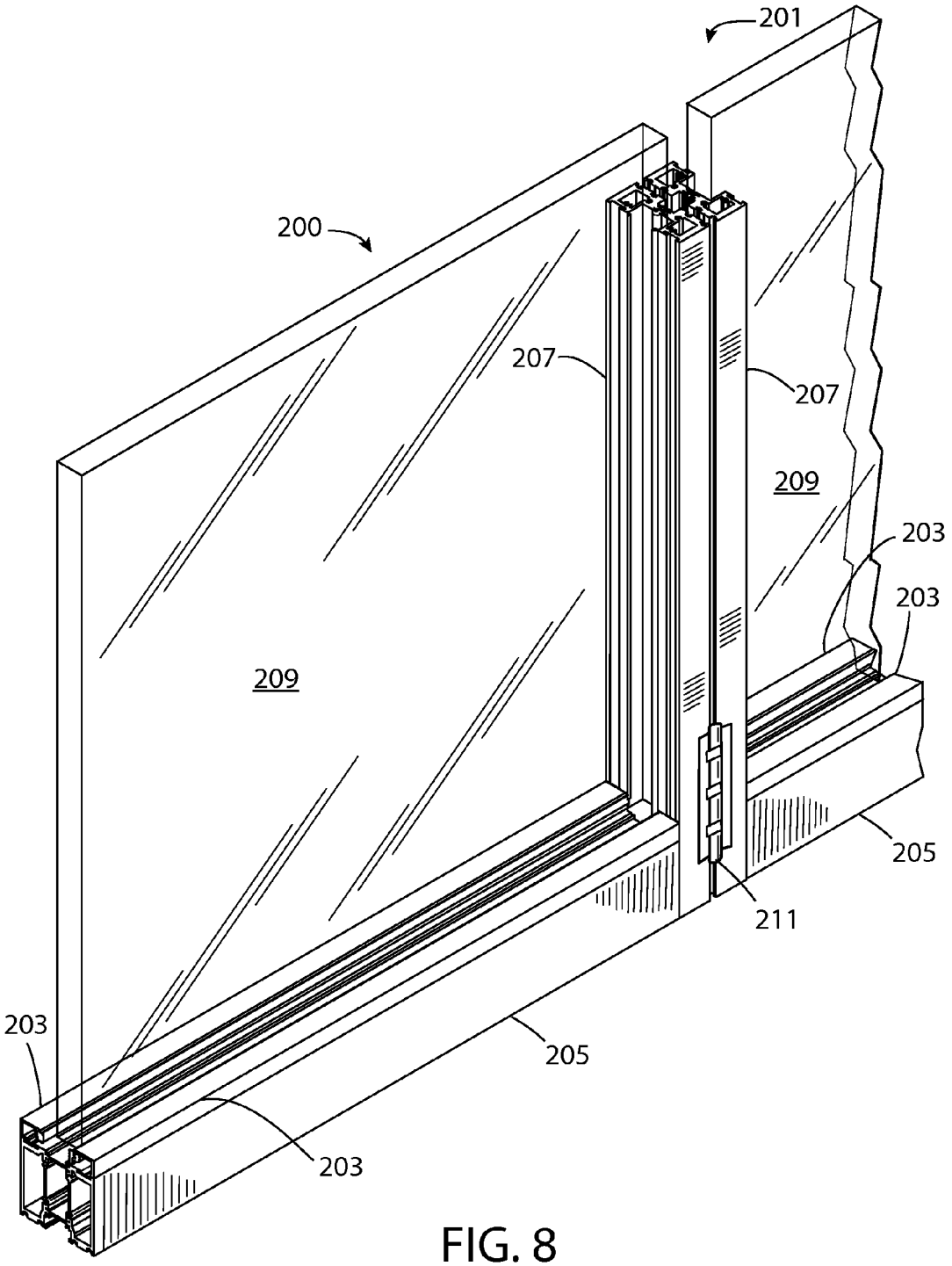
FIG. 8 illustrates the lower right hand portion of the glazed and framed door panel of FIG. 7.
Figure 13:
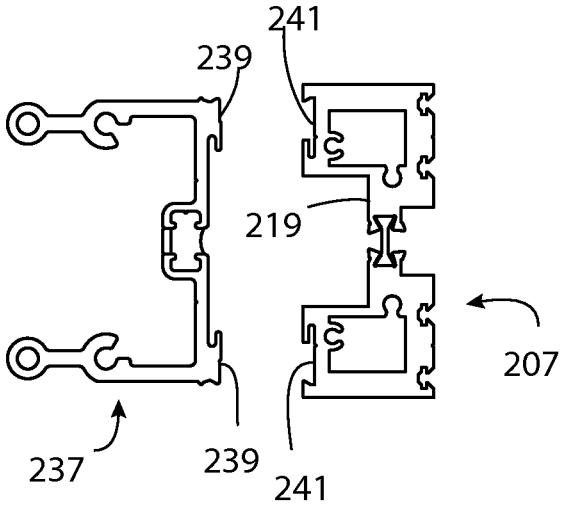
FIG. 13 illustrates a top exploded view of the lug and vertical marine glaze frame member of FIG. 12.
Figure 14:
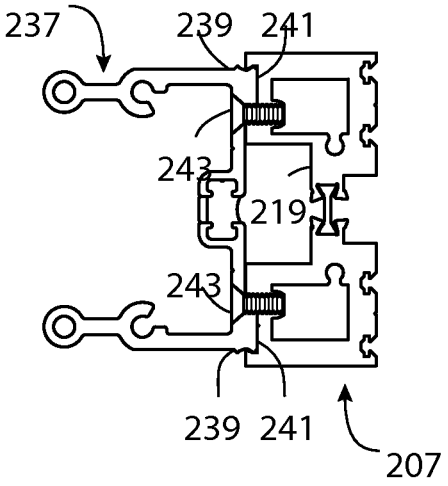
FIG. 14 illustrates a top assembled view of lug and vertical marine glaze frame member of FIG. 12.
Figure 15:
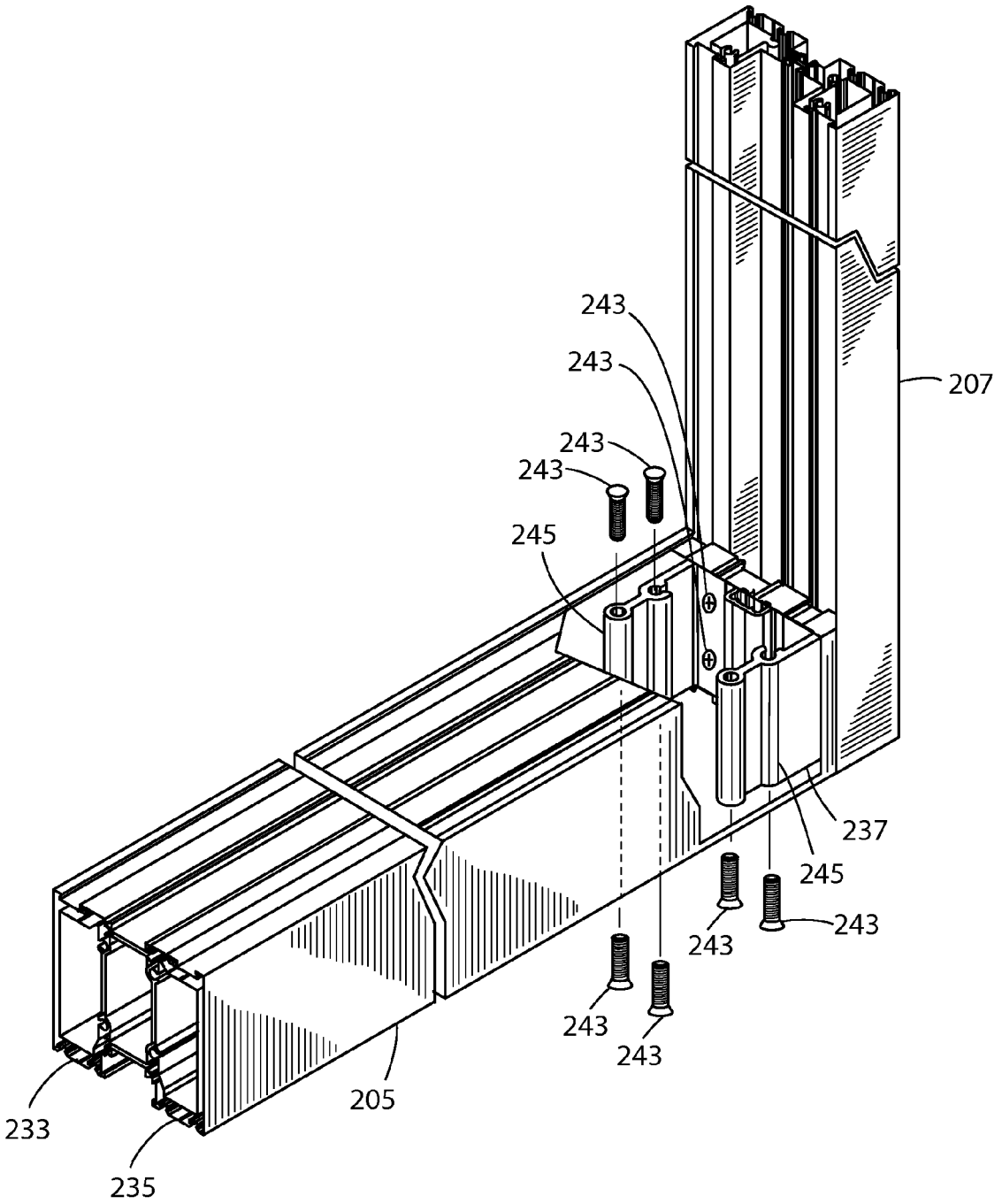
FIG. 15 illustrates the right vertical frame member and lower horizontal frame member of FIG. 7. The horizontal frame member is shown in partial cutaway to reveal the relationship between the lug and frame members.

One of the challenges faced by the inventor when combining the vertical marine glaze frame members 207 and horizontal stop glaze frame members 205 of FIGS. 7-8, was how to join the members together in order to create a structurally rigid frame capable of supporting the glazed framed door panel 200 for applications such as pivot doors, hinged doors, and glass folding door. Referring to FIGS. 11-15, the inventor recognized that a structurally rigid frame capable of supporting the glazed framed door panel for applications such as pivot doors, hinged doors, and glass folding door could be realized by utilizing a lug 237 that engaged the inward facing outer surface of the vertical marine glaze frame member 207 and at the same time, as shown in FIGS. 11 and 15, engaged and secured to the horizontal stop glaze frame member 205 through the first section hollow interior portion 233 and the second section hollow interior portion 235.

Figure 12:
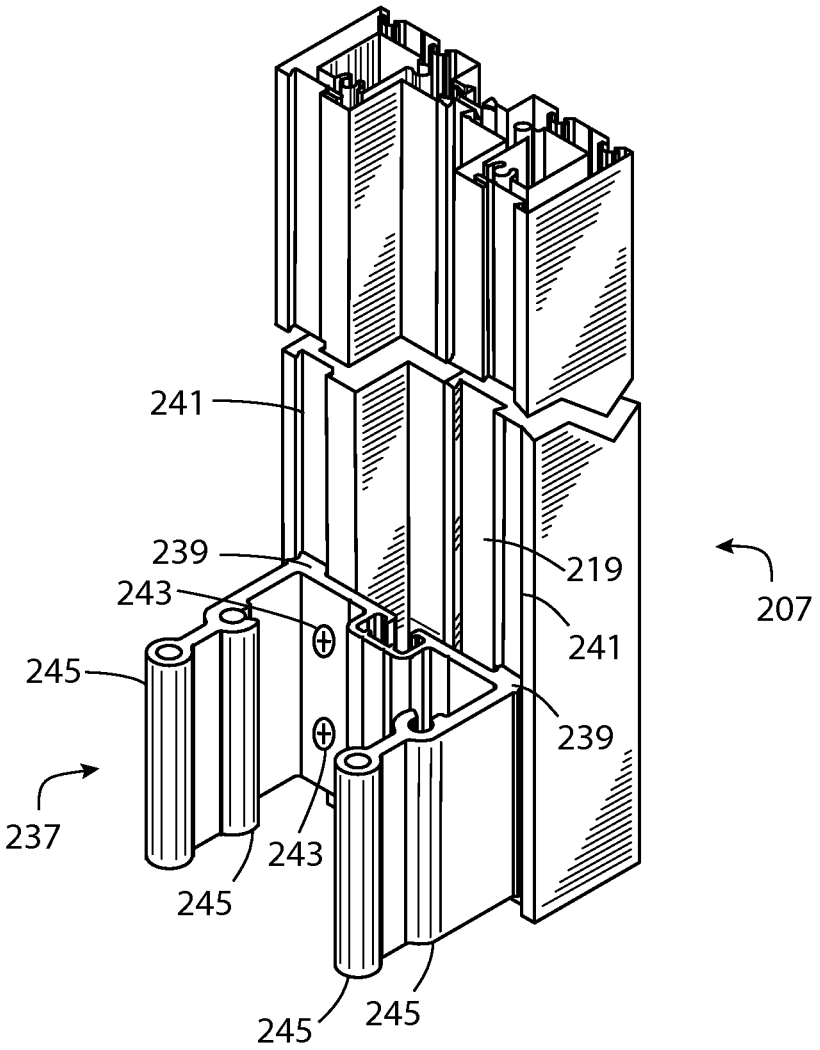
FIG. 12 illustrates a detail view of the vertical marine glaze frame member of FIG. 7 showing a lug attached.

FIG. 12 illustrates a detail view of the portion of the vertical marine glaze frame member 207 of FIG. 7 showing a lug 237 attached. FIG. 13 illustrates a top exploded view of the lug 237 and vertical marine glaze frame member 207 of FIG. 12. FIG. 14 illustrates a top assembled view of lug 237 and vertical marine glaze frame member 207 of FIG. 12. Referring to FIGS. 12-14, the lug 237 includes one or more ridges 239 that engage a corresponding one or more slots 241 on the surface of the vertical marine glaze frame members 207. Illustrated, are ridges 239 vertically oriented along opposing edges of the back surface of the lugs 237 and a pair of slots 241 corresponding to the position of the ridges 239 on either side of the u-shaped channel 219 on the inward facing surface of the vertical marine glaze frame member 207. The ridges 239 and the slots 241 are so shaped so that the lug 237 and the vertical marine glaze frame members 207 can be slid together but captively engaged. In FIG. 13, each ridge 239 has a shape complementary to its corresponding slot 241 in the sense that the ridge and slot are engaged in one slidable degree of freedom along the length of the vertical marine glaze frame member 207. In FIG. 13, the width of the cavity of the slot 241 is wider than the slot opening on the surface of the vertical marine glaze frame member 207. Similarly, the base of the ridge 239 is narrower than the projected portion of the ridge 239. In FIG. 14, once slid together, the lug 237 and the vertical marine glaze frame members are secured by threaded fasteners 243.

FIG. 15 illustrates the right vertical frame member and lower horizontal frame member of FIG. 7. The horizontal stop glaze frame member 205 is shown in partial cutaway to reveal the relationship between the lug 237, the horizontal stop glaze frame member 205, and the vertical marine glaze frame member 207. The lug 237 portion extending from the vertical marine glaze frame member 207 and lug 237 assembly is slide into the first section hollow interior portion 233 and the second section hollow interior portion 235. Threaded fasteners 243 secure to bosses 245 in the lug, in both FIGS. 12 and 15, and thereby secure the horizontal stop glaze frame member 205 to the vertical marine glaze frame member 207 and lug 237 assembly. This arrangement creates a structurally rigid frame suitable for non-supported applications such as a pivot door, swing door, or folding glass door.

Figure 16:
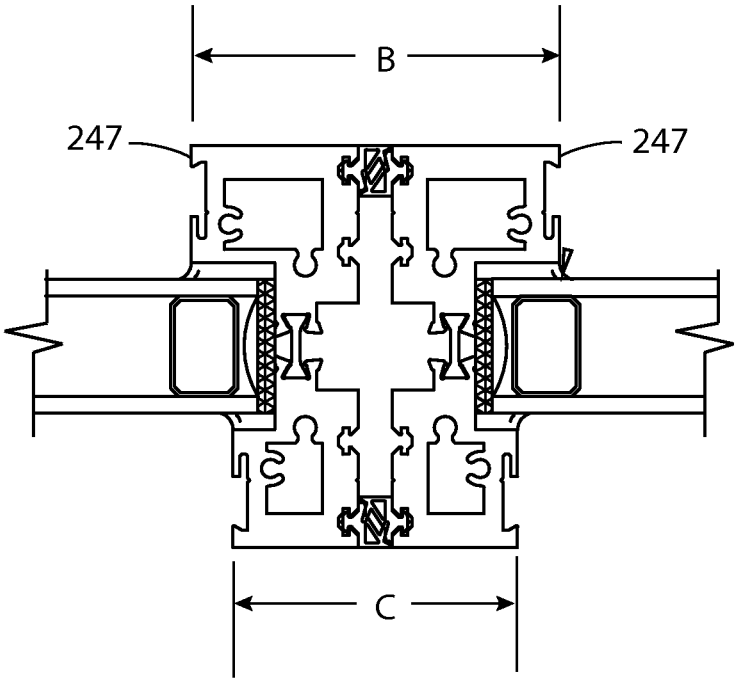
FIG. 16 illustrates, in sectional view, an alternative vertical marine glaze frame members adjoining in FIG. 7 that can typically be used in a fixed glass wall or fixed lite application.
Figure 17:
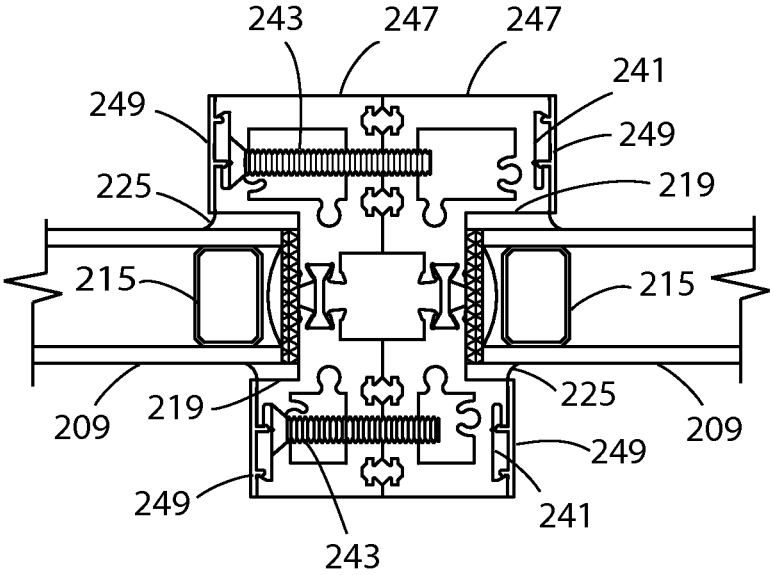
FIG. 17 illustrates, in sectional view, alternative vertical marine glaze frame members 247 adjoining in FIG. 16 with threaded fasteners to secure each of the alternative vertical marine glaze frame members and cover strips.

The vertical marine glaze frame members 207 of FIG. 9 is shown as an example in order to aid in the understanding of the present disclosure. FIGS. 16-19 illustrate other variations of vertical marine glaze frame members of the present disclosure. FIGS. 16-17 illustrates, in sectional view, an alternative vertical marine glaze frame members 247 adjoining in FIG. 7 that can typically be used in a fixed glass wall or fixed lite application. FIG. 16 shows the adjoining inside faces of the alternative vertical marine glaze frame members 247 is illustrated with the same profile width B as the vertical marine glaze frame member 207 of FIG. 7 but the adjoining outside faces of the alternative vertical marine glaze frame members 247 is illustrated with a narrower width indicated by measurement C. While the inside face of the alternative vertical marine glaze frame member 247 is illustrated with profile width B, the profile width can be adjusted to meet aesthetic and architectural requirements. For example, the width could be width C or even narrower than width C if desired.

FIG. 17 further illustrates, alternative vertical marine glaze frame members 247 adjoining in FIG. 16 with threaded fasteners 243 to secure each of the alternative vertical marine glaze frame members 247 and cover strips 249. The cover strips 249 can snap on, slide in, or otherwise attach to the slots 241. The cover strips 249 can cover the portions of the slots 241 not engaged by the lug 237 of the previous figures. This can help to create a more aesthetic appearance. The alternative vertical marine glaze frame members 247 are constructed similarly to the vertical marine glaze frame members 207 of FIG. 7. Illustrated in FIG. 17 are the glass panel 209, spacer 215, u-shaped channel 219, and marine glaze gaskets 225. The u-shaped channel 219 and the slots 241 in FIG. 17 can be similar configured as the u-shaped channel 219 and slots 241 of FIG. 15 so that there can be a commonality of parts shared between the two designs such as the lug 237 and the horizontal stop glaze frame member 205.

Figure 18:
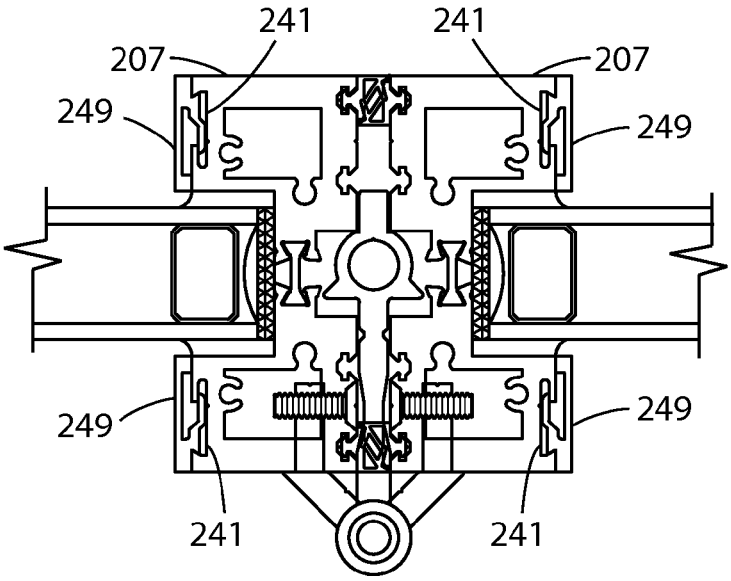
FIG. 18 illustrates the vertical marine glaze frame member of FIG. 9 with cover strips.

As in the FIG. 17, the vertical marine glaze frame members 207 of FIG. FIG. 9 can have trim added to create a more aesthetic appearance. FIG. 18 illustrates the vertical marine glaze frame members 207 of FIG. 9 with cover strips 249. As previously described, the cover strips 249 can snap on, slide in, or otherwise attach to the slots 241. The cover strips 249 can cover the portions of the slots 241 not engaged by the lug 237.

Figure 19:
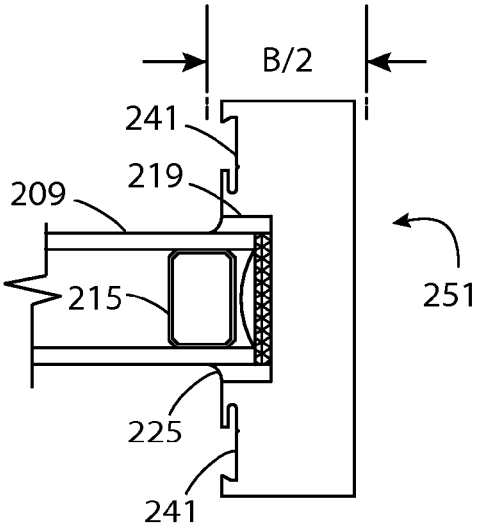
FIG. 19 illustrates, in sectional view, a second alternative vertical marine glaze frame member that can be utilized in non-thermally critical application.

The vertical marine glaze frame member of FIG. 7 and alternative vertical marine glaze frame member 247 of FIGS. 16-17 all include thermal breaks suitable for protecting the inside of a building from the outside elements. FIG. 19 illustrates, in sectional view, a second alternative vertical marine glaze frame member 251 that can be utilized in non-thermally critical application, for example, in warm climates, or where minimizing the vertical site line is more important than thermal isolation. Because the second alternative vertical marine glaze frame member 251 does not have a thermal break, the structure is simplified and an even thinner front and back face profile can be realized. This is illustrated by the measurement B/2 which represents the width of one of the vertical marine glaze frame members 207 of FIG. 9 and is wider than the width of the second alternative vertical marine glaze frame member 251. The second alternative vertical marine glaze frame members 251 are constructed similarly to the vertical marine glaze frame members 207 of FIG. 9. Illustrated in FIG. 19 are the glass panel 209, spacer 215, u-shaped channel 219, and marine glaze gaskets 225. As previously described for FIG. 17, the u-shaped channel 219 and the slots 241 in FIG. 19 can be similar configured as the u-shaped channel 219 and slots 241 of FIG. 15 so that there can be a commonality of parts shared between the designs such as the lug 237 and the horizontal stop glaze frame member 205 previously illustrated.

Figure 20:
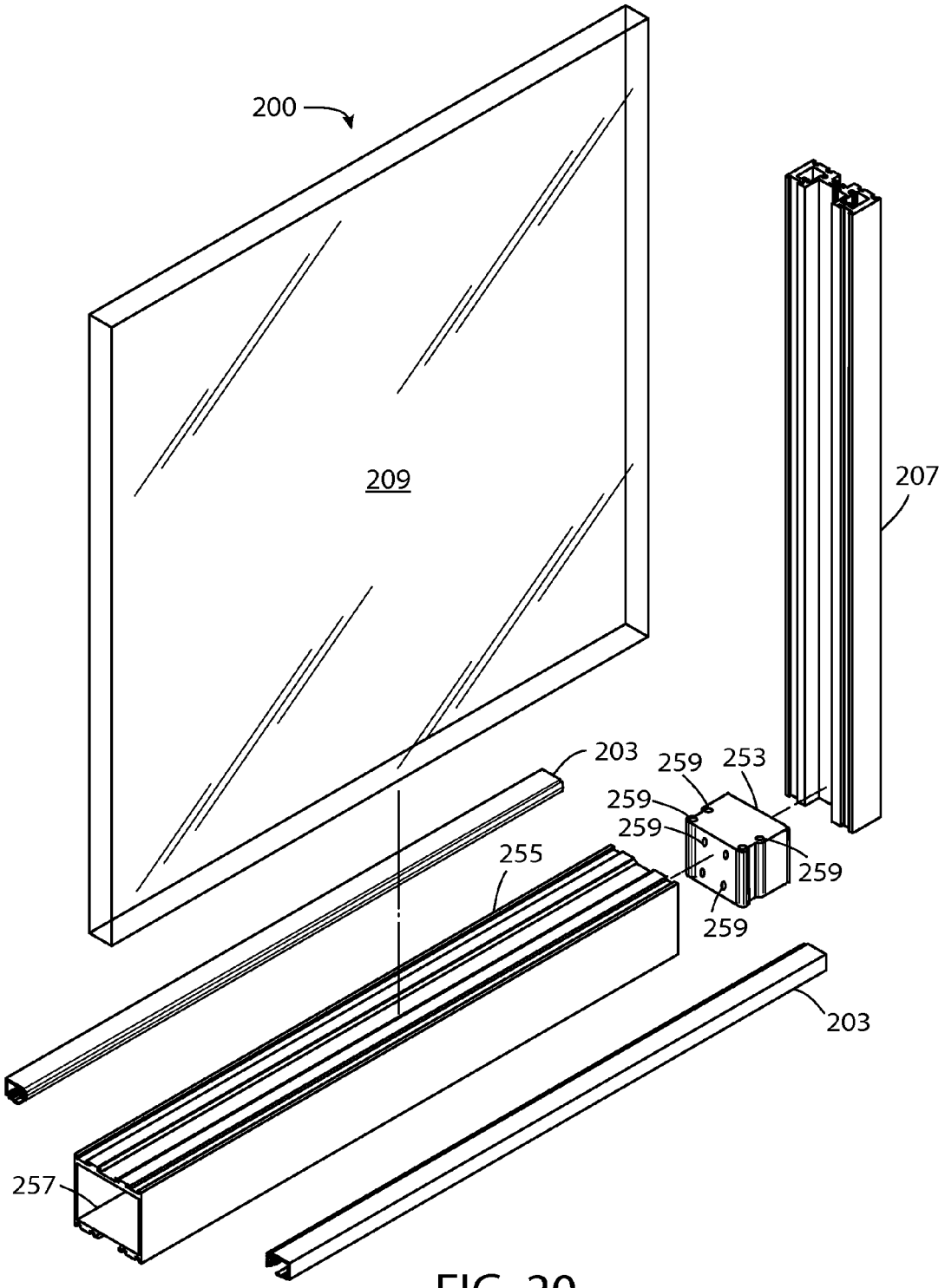
FIG. 20 illustrates, exploded view of the lower right hand portion of the glazed framed door panel of FIG. 7 utilizing an alternative lug.
Figure 21:
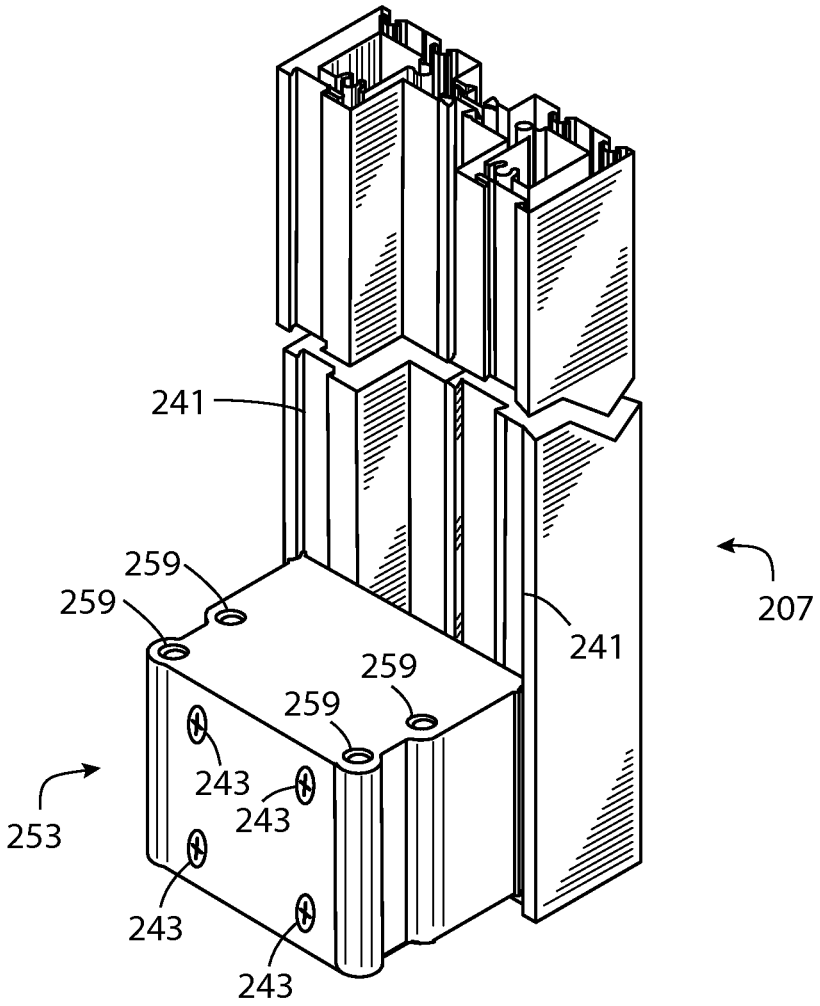
FIG. 21 illustrates, a detail view of the vertical marine glaze frame member of FIG. 20 showing the alternative lug attached.
Figure 22:
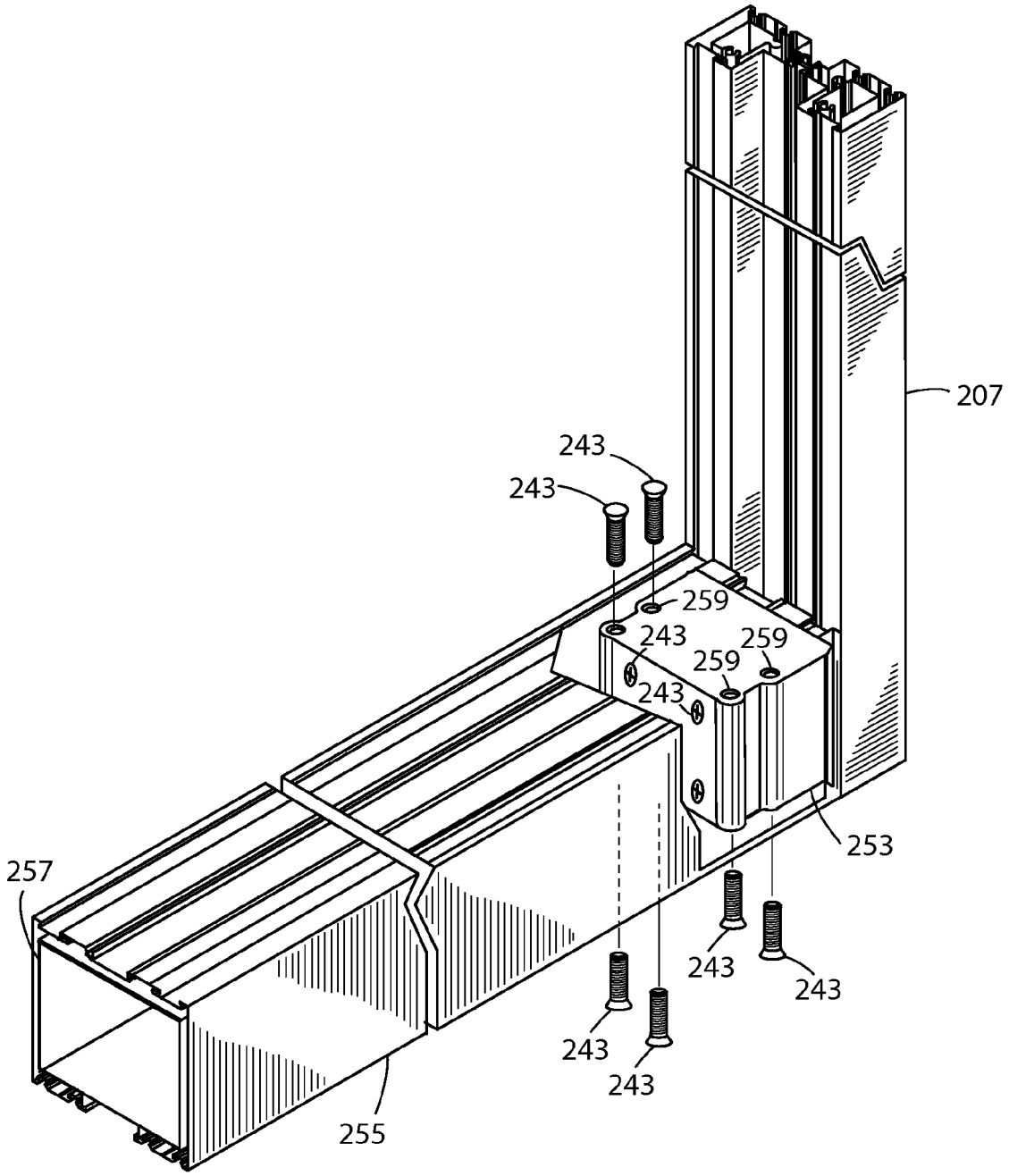
FIG. 22 illustrates, the right vertical frame member and lower horizontal frame member of FIG. 20. The horizontal frame member is shown in partial cutaway to reveal the relationship between the alternative lug and frame members.

FIG. 20 illustrates, exploded view of the lower right hand portion of the glazed framed door panel of FIG. 7 utilizing an alternative lug 253. The alternative lug illustrated is made out of a solid block of rigid material such as aluminum. FIG. 21 illustrates, a detail view of the vertical marine glaze frame member 207 of FIG. 20 showing the alternative lug 253 attached. FIG. 22 illustrates the vertical marine glaze frame member 207 and an alternative horizontal stop glaze frame member 255 of FIG. 20. In FIG. 20, the alternative horizontal stop glaze frame member 255 is shown in partial cutaway to reveal the relationship between the alternative lug 253 and frame members. Referring to FIGS. 20-23, the alternative lug 253 that engaged the inward facing outer surface of the vertical marine glaze frame member 207 and at the same engages a hollow interior portion 257 of secured to the alternative horizontal stop glaze frame member 255 through a hollow interior portion 257. The alternative lug 253 includes apertures 259 on both the horizontal and vertical surfaces of the alternative lug 253. In FIGS. 21-22, the alternative lug 253 is secured to the surface of the vertical marine glaze frame member 207 by the threaded fasteners 243 passing into the vertical surface of the alternative lug 253 through the apertures 259 of FIG. 20.

Referring to FIG. 22, the alternative lug 253 portion extending from the vertical marine glaze frame member 207 and alternative lug 253 assembly is slid into the hollow interior portion 257 of the alternative horizontal stop glaze frame member 255. The threaded fasteners 243, shown exploded both above and below, extend into corresponding horizontal surfaces of the alternative horizontal stop glaze frame member 255 and into apertures 259 in corresponding horizontal surfaces of the alternative lug 253 thereby securing the vertical marine glaze frame member 207 and alternative lug 253 assembly to the alternative horizontal stop glaze frame member 255.

In FIG. 21, the alternative lug 253 does not slidably engage the slots 241 as described for the lug 237 of FIG. 12. Instead, the alternative lug rests on the surface of the vertical marine glaze frame member 207 and is secured directly by the threaded fasteners 243 as previously described.

Figure 23:
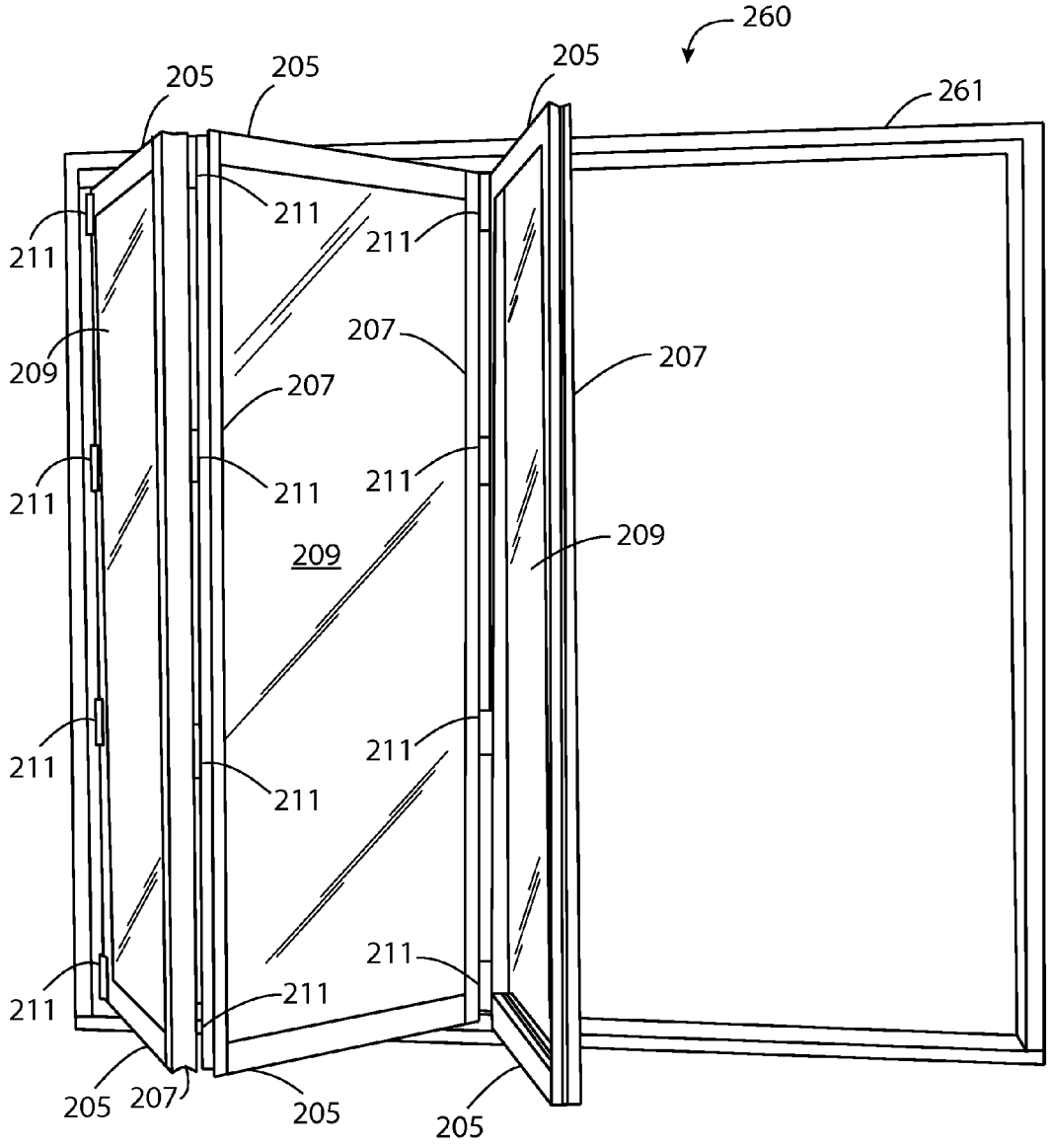
FIG. 23 illustrates the glazed and framed door panel of the present disclosure utilized in a folding door structure.

FIG. 23 illustrates the glazed and framed door panel of the present disclosure utilized in a folding door structure 260. Illustrated is a doorframe 261, the horizontal stop glaze frame members 205, the vertical marine glaze frame members 207, the glass panels 209, and hinges 211.

Figure 24:
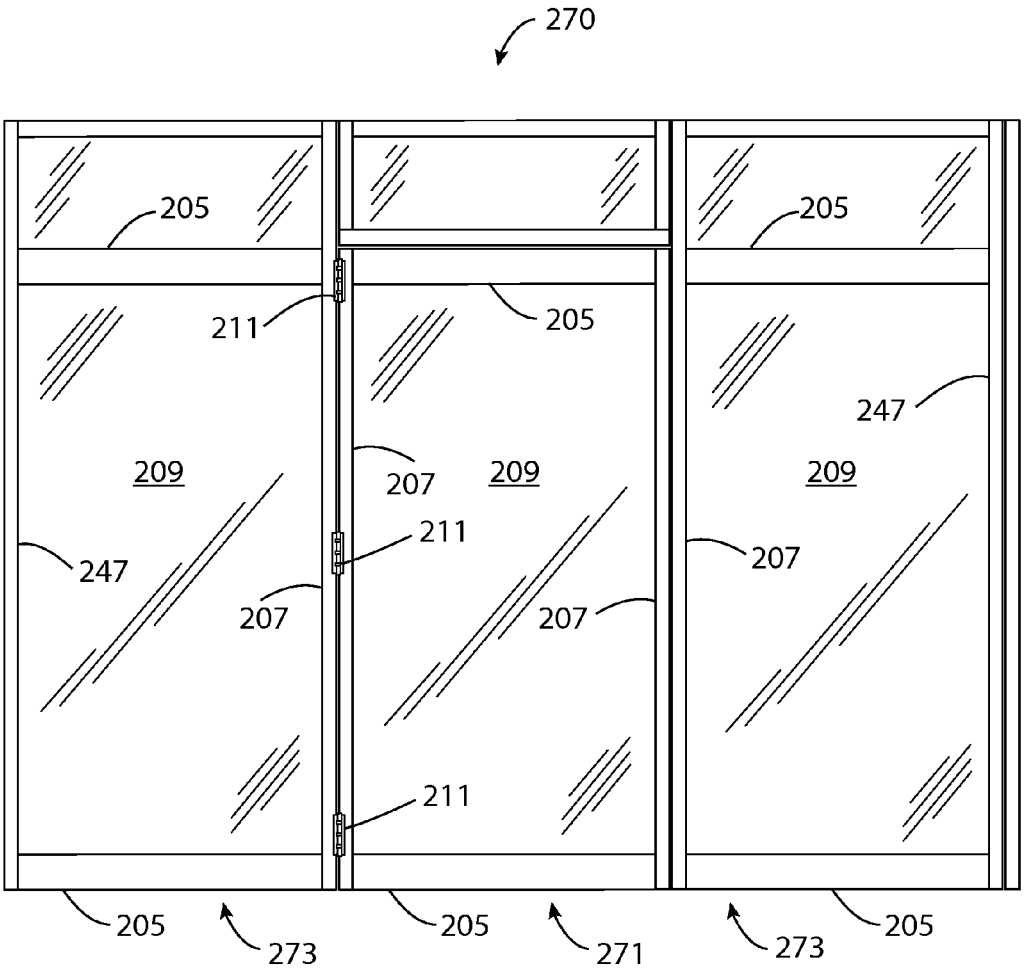
FIG. 24 illustrates the glazed and framed door panel structure of the present disclosure utilized in a swing door, and fixed framed glass panels, also known as fixed lites.
Figure 14:
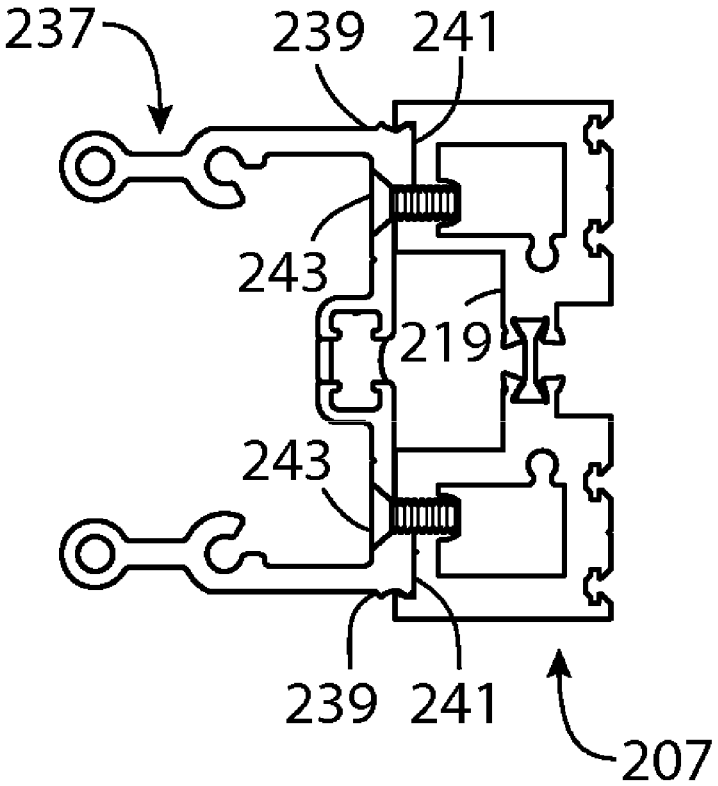

FIG. 24 illustrates the glazed and framed door panel structure 270 of the present disclosure utilized in a swing door 271, and fixed framed glass panels 273, also known as fixed lites. The swing door 271 includes horizontal stop glaze frame members 205, vertical marine glaze frame members 207, glass panels 209, and hinges 211. The door facing portions of the fixed framed glass panels 273 include horizontal stop glaze frame members 205, vertical marine glaze frame members 207, and glass panels 209. The vertical sides opposing the swing door include alternative vertical marine glaze frame members 247.

A framed glazed door and wall structure has been described. It is not the intent of this disclosure to limit the claimed invention to the examples, variations, and exemplary embodiments described in the specification. Those skilled in the art will recognize that variations will occur when embodying the claimed invention in specific implementations and environments. For example, it is possible to implement certain features described in separate embodiments in combination within a single embodiment. Similarly, it is possible to implement certain features described in single embodiments either separately or in combination in multiple embodiments. It is the intent of the inventor that these variations fall within the scope of the claimed invention. While the examples, exemplary embodiments, and variations are helpful to those skilled in the art in understanding the claimed invention, it should be understood that, the scope of the claimed invention is defined solely by the following claims and their equivalents.

What is claimed is:

1. A framed and glazed door or wall panel, comprising:

a glass panel;

marine glaze gaskets;

a frame surrounding the glass panel comprising a pair of vertical marine glaze frame members positioned on opposing vertical edges of the glass panel, a pair of horizontal stop glaze frame members positioned on opposing horizontal edges of the glass panel and secured between each vertical marine glaze frame member of the pair of vertical marine glaze frame members and forming a corresponding rigid corner joints thereto;

each horizontal stop glaze frame member comprises a pair of removable frame sections comprising removable glazing stops, on opposing faces of the glass panel, each removable frame section contacting an edge of the glass panel; and each vertical marine glaze frame member includes a longitudinal slot along the length of the vertical marine glaze frame that receives the marine glaze gasket, the marine glaze gasket and longitudinal slot in combination directly seat and engage a vertical edge of the opposing vertical edges of the glass panel.

2. A framed and glazed door or wall panel of claim 1, further comprising:

a plurality of lugs; and each horizontal stop glaze frame member of the pair of horizontal stop glaze frame members includes a hollow interior end portion that receives and engages a corresponding lug of the plurality of lugs, the corresponding lug engages and secures to an end portion exterior surface of a corresponding adjacent vertical marine glaze frame member.

3. The framed and glazed door or wall panel of claim 2, wherein the corresponding lug captively and slidably engages lengthwise along the end portion exterior surface of the corresponding adjacent vertical marine glaze frame member.

4. The framed and glazed door or wall panel of claim 2 wherein:

the corresponding lug includes a vertical ridge;

the end portion exterior surface includes a lengthwise slot; and the vertical ridge captively and slidably engages the lengthwise slot.

5. The framed and glazed door or wall panel of claim 2 wherein:

the end portion exterior surface includes a lengthwise u-channel adapted to engage the glass panel, and a pair of lengthwise slots, each slot of the pair of lengthwise slots, positioned on opposing sides of the lengthwise u-channel; and the corresponding lug including a pair of vertical ridges captively and slidably engaging the pair of lengthwise slots.

6. The framed and glazed door or wall panel of claim 1 further comprising:

a plurality of lugs;

a butt joint formed between one of the vertical marine glaze frame member of the pair of vertical marine glaze frame members, an adjacent horizontal stop glaze frame member of the pair of horizontal stop glaze frame members, and corresponding lug, of the plurality of lugs, with the corresponding lug engaging an interior portion of the adjacent horizontal stop glaze frame member and an exterior portion of the vertical marine glaze frame member.

7. A framed and glazed door or wall panel, comprising:

a glass panel;

a first and second pair of removable glazing stops;

a frame surrounding the glass panel comprising a pair of vertical marine glaze frame members and marine glaze gasketing that in combination are positioned directly against opposing vertical edges of the glass panel, a first and second horizontal stop glaze frame members positioned on opposing horizontal edges of edges of the glass panel and secured between each vertical marine glaze frame member of the pair of vertical marine glaze frame members and forming a corresponding rigid corner joints thereto;

the first and the second horizontal stop glaze frame members each include a pair of removable glazing stops that are positioned against opposing faces of the glass panel.

* * * * *

UNITED STATES PATENT AND TRADEMARK OFFICE

CERTIFICATE OF CORRECTION

PATENT NO. : 8,997,412 B1
APPLICATION NO. : 14/219762
DATED : April 7, 2015
INVENTOR(S) : Gregory Header It is certified that error appears in the above-identified patent and that said Letters Patent is hereby corrected as shown below:

IN THE DRAWINGS:

Replace FIG. 14 with figure on attached page.

IN THE SPECIFICATION:

In column 7, line 44, replace "Referring to FIGS. 20-23" with "Referring to FIGS. 20-22".

IN THE CLAIMS:

In Claim 7, column 10, line 18, replace "horizontal edges of edges of" with "horizontal edges of".

Signed and Sealed this
Twenty-ninth Day of March, 2016

Michelle K. Lee

Michelle K. Lee
*Director of the United States Patent and Trademark Office*